US007469795B2

(12) United States Patent
Druitt et al.

(10) Patent No.: US 7,469,795 B2
(45) Date of Patent: Dec. 30, 2008

(54) FLIP TOP CLOSURE

(75) Inventors: Rodney Malcolm Druitt, Studley (GB); David Edward Foster, Evesham (GB)

(73) Assignee: Rexam Closures and Packaging Services (UK) Limited, London (GB)

( * ) Notice: Subject to any disclaimer, the term of this patent is extended or adjusted under 35 U.S.C. 154(b) by 484 days.

(21) Appl. No.: 10/821,191

(22) Filed: Apr. 9, 2004

(65) Prior Publication Data

US 2004/0256347 A1 Dec. 23, 2004

(30) Foreign Application Priority Data

Apr. 16, 2003 (AU) ..... 2003901850

(51) Int. Cl.
*B65D 47/08* (2006.01)
*B65D 47/10* (2006.01)

(52) U.S. Cl. ..... 215/235; 215/253; 215/344

(58) Field of Classification Search ..... 215/250, 215/253, 235, 341, 343, 344, 252, 258, 237; 222/556, 153.14, 153.05, 153.06; 220/837, 220/839

See application file for complete search history.

(56) References Cited

U.S. PATENT DOCUMENTS 4,505,401 A * 3/1985 Berglund ..... 215/252
4,638,917 A * 1/1987 Persch ..... 215/252
4,828,127 A * 5/1989 Young et al. ..... 215/252
4,860,907 A * 8/1989 Sondal ..... 215/230
4,907,708 A * 3/1990 Csaszar ..... 215/252
4,919,286 A * 4/1990 Agbay, Sr. ..... 215/235
5,033,632 A * 7/1991 Mattia et al. ..... 215/252
5,423,444 A 6/1995 Druitt
5,499,736 A * 3/1996 Kohl ..... 220/254.5
5,782,369 A 7/1998 Tansey
5,856,665 A * 1/1999 Price et al. ..... 250/205
6,325,225 B1 * 12/2001 Druitt et al. ..... 215/252
6,520,370 B2 * 2/2003 Nyman et al. ..... 220/832
6,926,162 B1 * 8/2005 Culley ..... 215/252
7,051,888 B2 * 5/2006 Antier et al. ..... 215/235

* cited by examiner

*Primary Examiner*—Robin Hylton
(74) *Attorney, Agent, or Firm*—McDermott Will & Emery LLP

(57) ABSTRACT

A closure (10) that is suitable for attachment to a container (20) having an end portion defining an opening of the container. The closure comprises a top (11), a skirt (12), a support ring (30) that is engageable with the end portion of the container and which is hingedly connected to the skirt (12), and a sealing rib (13). The sealing rib (13) has a first portion (14) and a second portion (15). The length of the second portion (15) is such that, during attachment of the closure (10) with the end portion of the container (20), the end portion of the container contacts the second portion (15) and pushes it upwardly and at least towards the first portion (14) so as to form a seal between the end portion of the container (20) and the closure (10).

20 Claims, 2 Drawing Sheets

FLIP TOP CLOSURE

TECHNICAL FIELD

The present application relates to a linerless closure for a container including, but not limited to, a container for beverages, including aerated and carbonated beverages. More particularly, the application relates to such closures that can be formed of a synthetic plastics material and be moulded in one piece for use in sealing containers.

BACKGROUND ART

Resealable push-pull closures (or as they are sometimes called, "sports closures") allow a person to pour out a container's contents without the need to fully remove the closure from the container.

Such closures typically comprise a main cap that seals the container in the manner of normal closures as known in the art. The top surface of the main cap normally has an opening in fluid communication with the bore of a spout. The spout in turn has a plug member that partially blocks the bore. To seal the container, a top cap, which also has an aperture, is mounted to the spout. The top cap is normally movable between at least a first position in which its aperture is sealed by the plug member so sealing the container and a second position in which the aperture is not sealed by the plug member so allowing the container's contents to exit from the container around the plug member and through the aperture of the top cap.

The top cap is generally mounted to the spout in a manner such that is readily movable between the first and second positions by only one hand or even by the teeth. This traditionally has made the closure popular with sportspersons, such as runners or cyclists, who may wish to consume a product but who may only have one hand free whilst participating in their sport.

The use of such a closure is, however, not only restricted to containers for sports drinks and they have found application in an ever wider range of container types and products in general use by consumers. For example, the closures have been used to seal containers containing beverages marketed at children.

One problem with such closures is the relatively complex construction necessary to form the closure and provide the resealing capability. The use of a spout and the typically relatively smaller opening in the top cap also restricts the rate of flow of the beverage from the container which can be disadvantageous in certain instances.

Containers for aerated or carbonated beverages should also be sealed by closures that can withstand the increase in pressure created within the container by the aeration or carbonation of the beverage. The closures should also retain a sufficient degree of sealing to prevent loss of gas from the container in the time between filling of the container and eventual consumption of the beverage by the consumer.

U.S. Pat. No. 5,423,444 discloses a plastics closure for a container having an externally screw threaded neck, the closure including a top portion and an internally threaded skirt. The closure has an annular sealing rib which projects downwardly from the underside of the top portion. The rib includes a first substantially cylindrical portion contiguous with the underside of the top portion and lying adjacent to or abutting with the skirt, and a second, frusto-conical, portion contiguous with the end of the first portion distal to the underside of the top portion and extending radially inwardly to a circular free edge. During threaded attachment of the closure with the neck, the second, frusto-conical, portion is engaged by a free end of the neck and folded back toward or against the first, substantially cylindrical portion of the rib to form a gas tight seal between at least the outer surface of the neck of the container and the closure.

The present invention is directed to an alternative to the sports closure that can be opened and re-closed, if necessary, using just one hand.

DISCLOSURE OF THE INVENTION

The present application relates to a closure for a container, a container/closure combination, a method of forming the closure, a mould for use in making the closure, and a method of capping a container with the closure.

In the present specification, the closure is defined as being suitable for attachment to an end portion of the container. The end portion of the container to be sealed by the present invention can have a free end, an outside, preferably cylindrical, surface and an inside, preferably cylindrical, surface. The inside surface defines a bore in the end portion or neck of the container. Either or both of the respective joins between the free end and the inside surface and between the free end and the outside surface can be smoothly curved and define respectively what are hereinafter called the inner and outer sealing radii of the end portion of the container. It will be appreciated that the end portion of the container could be formed without either the inner or outer sealing radii or both.

According to one aspect, the present invention is a closure suitable for attachment to a container having an end portion defining an opening of the container, the closure comprising:

a top portion;

a skirt portion depending from the top portion to an end distal the top portion, said top portion and skirt portion defining a cavity;

a support ring which is hingedly connected to said skirt portion;

a first sealing portion which is at least adjacent the top portion and having a cylindrical inner surface; and a second sealing portion separated from the top portion by the inner surface of the first portion and which, prior to attachment of the closure to the container, extends at least inwardly into said cavity for a length to a free edge positioned inwardly of the skirt portion;

wherein the length of the second portion is such that, during attachment of the closure with the end portion of the container, the end portion of the container contacts the second portion and pushes it upwardly and at least towards the first sealing portion of the closure to form a seal between the end portion of the container and the closure.

In one embodiment, the support ring and skirt portion are hingedly connected by a single hinge member that extends between the support ring and the skirt portion of the closure. The hinge member can have a first end mounted to the skirt portion at or adjacent the distal end of the skirt portion. A second end of the hinge member can be mounted to the support ring. In one embodiment, the hinge member can have a line of weakness formed therein about which the skirt portion can pivot relative to the support ring.

The skirt portion of the closure can be relatively movable to the support ring about the hinge member. In one embodiment, the skirt portion is movable from a closed position where the end portion of the container is sealed by the closure to an open position where the skirt portion has pivoted about the hinge member relatively away from the support ring. It will be appreciated that the skirt portion could pivot to one of a number of different open positions. In one embodiment, the skirt portion can pivot about the hinge through at least 180°.

In a further embodiment, the hinge member can be formed integrally with the skirt portion and/or the support ring.

On attachment of the closure to the end portion of the container, the closure can be constructed such that the skirt portion is in the closed position relative to the support ring. In this case, the closure can be formed in one piece and be ready to be attached to the end portion of the container and so seal that end portion without any necessity for post-moulding assembly of the closure.

In addition to being hingedly mounted to the support ring, one or more frangible bridges can extend between the skirt portion of the closure and the support ring prior to and while the closure is attached to the end portion of the container. In one embodiment, the bridge or bridges can extend between the distal end of the skirt portion and an adjacent edge of the support ring. The one or more frangible bridges can be constructed to break when an attempt is made to move the skirt portion from the closed position to any opened position. In this regard, the frangible bridges may be shorter in circumferential length and/or have a smaller width than the hinge member.

The frangible bridges can provide tamper evidence for the closure as the presence of broken bridges serve to readily identify previous opening of the closure.

In a further embodiment, a plurality of frangible bridges can extend between the skirt portion and the support ring. In one embodiment, the bridges can be substantially equally spaced around the circumference of the skirt portion except in the region of the hinge member. In another embodiment, the frangible bridges can be non-equally spaced around the circumference of the skirt portion. In one embodiment, one, two, or more bridges can extend between the skirt portion and the support ring at a location distal the hinge member. In one embodiment, these one or more bridges can be diametrically opposed to the location of the hinge member. A further set of one, two, three or more bridges can extend between the skirt portion and the support ring and be located on one or both sides of the hinge member. In yet a further embodiment, a set of three bridges can be located each side of the hinge member and be spaced an equal distance therefrom.

In one embodiment, the one or more bridges more distal the hinge member can be more readily frangible than the one or more bridges that are relatively closer to the bridge member.

In a still further embodiment, the bridges can decrease in circumferential width towards the skirt portion end of the bridge. In addition to or instead of this decrease, the bridges can decrease in diametric thickness towards the skirt portion end of the bridge. This decrease can serve to cause preferential rupturing of the bridges at or adjacent the connection of the bridges with the distal end of the skirt portion.

In a still further embodiment, the skirt portion end of the bridges can be joined to the skirt portion in a recess formed in the distal end of the skirt portion. The bridges can rupture such that the break in the bridge is at least partially, and even wholly, within the recess. In one embodiment, the spacing between the distal end of the skirt portion and the adjacent edge of the support ring, except at the location of the recesses is about 0.5 mm. Each recess can have a depth of about 0.1 mm, such that the length of each bridge is about 0.6 mm. The recessed location of the rupture can serve to ensure that any sharp edges formed by the rupture of the bridges are positioned within the recess and hence do not strike a consumer using the container with the closure positioned in its opened position.

In a further embodiment, the support ring can comprise a generally cylindrical body portion and a rib extending inwardly of the body portion that provides a lip having an inner free edge to engage under a retaining flange extending outwardly from the end portion of the container but spaced a distance from the free end thereof. The rib can be continuous along its length but need not extend the full circumference of the inner surface of the body portion. In one embodiment, the rib can stop short of the location of the hinge member.

The rib can have an upper surface facing generally towards the top portion of the closure and an underside facing generally away from the top portion. The inner surface of the support ring can also have a plurality of radially inward projections or ramps extending from above the free edge of the ring and not extending beyond the inner free edge of the lip. In one embodiment, the projections can be equally spaced about the circumference of the inner surface except in the location of the hinge member.

The upper surface of the rib extending inwardly of the body portion can be a compound surface and comprise a first surface contiguous with the body portion of the ring, which surface has a slope that slopes inwardly and downwardly away from the top portion, and a second surface which extends radially inwardly from the inner terminus of the first surface and has a slope angle substantially normal, or normal, to the body portion of the ring.

In addition to the rib, an undercut can be formed on the inner surface of the support ring above the rib. The undercut provides an abutment surface. The undercut can define the upper extremity of a region of the body portion that is thinner than the body portion immediately above and below that region. The abutment surface provided by the undercut can bear on the upper surface of the retaining flange of the container on relatively downward movement of the support ring on the end portion and so resist that downward movement. The abutment surface can be formed substantially at right angles to the inner surface of the body portion of the support ring. The spacing of the undercut from the upper surface of the rib can be just greater than the thickness of the retaining flange on the container. The combination of the rib and the undercut serves to hold the support ring in position on the end portion of the container, especially when the skirt portion is moving from the closed to the opened position.

The outer surface of the support ring can be cylindrical. In another embodiment, the outer surface can have one or more projections extending outwardly therefrom. In one embodiment, the projections can be located adjacent the upper edge of the support ring. Each of the projections can have a circumferential length that is longer than its height. The projections can serve to stiffen the ring adjacent its connection to the bridges. This increase in stiffness assists in ensuring that the closure can be positioned on the end portion of the container without breaking the bridges. The projections can be equally spaced about the circumference of the ring support except in the location of the hinge member.

In a further embodiment, the closure further comprises an annular sealing rib. The annular sealing rib can include the first sealing portion defined above. In a further embodiment, the first sealing portion of the sealing rib can be contiguous with the top portion and project downwardly from an underside of the top portion. The first portion can project downwardly from the underside of the top portion and be spaced inwardly from the skirt portion. In another embodiment, the first portion can be spaced from the skirt distance a relatively small distance such that at least some of the outer surface of the first sealing portion abuts the skirt portion prior to, during attachment, and/or after attachment of the closure to the end portion of the container. In yet a further embodiment, the first sealing portion can be contiguous with the skirt portion at least adjacent the join between the top portion and the skirt portion. For example, the first sealing portion can comprise a thickening of the skirt portion in the region adjacent the top portion and, still further, in the region adjacent its connection to the top portion. By comprising such a thickening, the root of the second sealing portion, when contiguous with the first sealing portion, is moved inwardly of the part of the skirt portion having an attachment arrangement thereon, such as is described below.

In a still further embodiment, the sealing rib can also include the second portion defined above. In this embodiment, the second portion can be contiguous with the first portion. Even further, the second portion can be contiguous with an end of the first portion distal the top portion. The second portion can extend for a length inwardly and downwardly from the distal end of the first portion to a circular free edge. In one embodiment, the second portion can be at least substantially frusto-conical, and, still further, can be frusto-conical for some or all of its length.

The second portion of the sealing rib can be moulded at an angle of between about 10° and 75° relative to a notional plane extending at a right angle to the skirt portion of the closure.

In one embodiment, the second portion can firstly extend both inwardly and downwardly from the distal end of the first portion and then extend just downwardly for a length to the free edge. In another embodiment, the second portion can be non-linear. In this regard, the second portion can be partially or continuously curved.

The internal diameter of the inner surface of the first sealing portion of the closure relative to the external diameter of the end portion of the container can be such that the second sealing portion, on attachment of the closure, is folded back towards or against the inner surface of the first sealing portion. In this embodiment, a seal is at least formed between the closure and at least the outer surface of the end portion of the container at a position away from the free end of the container end portion.

There also can be at the line of meeting of the first and second portions of the sealing rib, a weakened zone or annular region of weakness to assist even deformation of the second portion relative to the first portion as the closure is attached to a container as is described in Australian Patent No 637706, the contents whereof are incorporated herein by reference.

The underside of the top portion of the closure can also have a continuous or segmented annular ridge radially inside of the sealing rib. The upper side of the second portion of the rib may also be formed with a complementary continuous or segmented annular ridge as is described in U.S. Pat. No. 5,782,369, the contents whereof are incorporated herein by reference. On attachment of the closure with the end portion, the complementary ridge on the second portion can engage with the underside of the top portion. Where the underside of the top portion has a ridge formed thereon, the respective ridges can interlock as the closure is attached to the container thereby holding the sealing rib touching the underside of the top portion stationary and causing the second portion of the sealing rib to be disposed over a still greater area of the underside of the top portion as well as the outer surface of the end portion.

The closure can be provided with an annular bead on an inside surface of the skirt portion that is engageable with a corresponding annular bead on an external surface of the end portion of the container. In this embodiment, the spacing of the annular bead from the top portion on the closure is slightly longer than the spacing between the annular bead and the free end of the end portion of the container. As such, the annular bead on the closure is adapted to ride out and over the bead on the end portion and engage therebeneath on attachment of the closure to the end portion and also when the closure is moved back to a closed position from an opened position.

In the above embodiment, one or both of the respective beads can be continuous of discontinuous.

While annular nubs are described above, it is possible for the container and the closure to be formed with other complementary attachment arrangements. Such an arrangement could, for instance, comprise a snap-on attachment arrangement having a rib on the inside surface of the closure and a corresponding groove on the outside surface of the end portion of the container.

In yet a further embodiment, the skirt portion is cylindrical and depends from the top portion of the closure. In one embodiment, a finger pad can extend out from the skirt distal the hinge member and allow a user or consumer to more readily exert relatively upward pressure on the top portion of the closure when that person wishes to move the skirt portion of the closure from its closed to an open position. By exerting sufficient pressure, the frangible bridges distal the hinge firstly break and the skirt portion begins to pivot relative to the support ring about the hinge member thereby opening the container.

In a still further embodiment, the height of the support ring can be such that the ring, once attached to the end portion of the container, is held substantially in position on the end portion between respective retaining flanges. The first retaining flange on the end portion of the container can be as described above and serves to abut with the lip of the segmented rib on the inside surface of the ring. A second retaining flange can be spaced below the first retaining flange a distance that ensures there is abutment with the lower edge of the support ring when the support ring has ridden over and is below the first retaining flange. While the spacing between the respective retaining flanges can be such to hold the support ring in position, it will be appreciated that some movement of the support ring longitudinally on the end portion of the container between the retaining flanges would be acceptable.

In a second aspect, the present application is directed to a separate invention which is a closure suitable for attachment to a container having an end portion defining an opening of the container, the closure comprising:

a top portion;

a skirt portion depending from the top portion to an end distal the top portion, said top portion and skirt portion defining a cavity; and a support ring which is connected to said skirt portion by one or more frangible bridges that extend between the skirt portion and the support ring;

wherein at least one of said one or more bridges has a first end joined to the skirt portion in a respective recess formed in the distal end of the skirt portion.

In this aspect, each of said bridges can have a first end joined to the skirt portion in a recess formed in a respective recess formed in the distal end of the skirt portion. In this aspect, the bridges can be constructed so as to rupture such that the break in the bridge is at least partially, and can be wholly, within the recess. In one embodiment, the spacing between the distal end of the skirt portion and the adjacent edge of the support ring, except at the location of the recesses is about 0.5 mm. Each recess can have a depth of about 0.1 mm, such that the length of each bridge is about 0.6 mm.

The closure according to this aspect can have one or more of the features defined herein with respect to the first aspect of the invention.

In a third aspect, the present application is directed to a still further separate invention which is a closure suitable for attachment to a container having an end portion defining an opening of the container, said end portion having a retaining flange extending outwardly from the end portion and spaced a distance from the free end thereof, the closure comprising:

a top portion;

a skirt portion depending from the top portion to an end distal the top portion, said top portion and skirt portion defining a cavity; and a support ring that is engageable with the end portion of the container and which is connected to said skirt portion by a frangible connection;

wherein said support ring comprises a generally cylindrical body portion having a rib extending inwardly of the body portion that provides a lip having an inner free edge to engage under the retaining flange, and an undercut providing an abutment surface that is formed in the inner surface of the body portion above the rib and which is engageable with an upper surface of the retaining flange on relatively downward movement of the support ring to the end portion.

In one embodiment of this aspect, the frangible connection can comprise one or more frangible bridges that extend between the skirt portion and the support ring.

In this aspect, the undercut can define the upper extremity of a region of the body portion that is thinner than the body portion immediately above and below that region. The abutment surface provided by the undercut can bear on the upper surface of the retaining flange of the container on relatively downward movement of the support ring on the end portion and so resist that downward movement. The abutment surface can be formed substantially at right angles to the inner surface of the body portion of the support ring. The spacing of the undercut from the upper surface of the rib can be just greater than the thickness of the retaining flange on the container. The combination of the rib and the undercut serves to hold the support ring in position on the end portion of the container, especially when the skirt portion is moving from the closed to the opened position.

The closure according to this aspect can have one or more of the features defined herein with respect to the first and second aspects of the invention.

The closures as defined above may be moulded from a synthetic plastics material. The closure can be formed from a suitable grade of polyethylene or polypropylene. The closure can also be formed in one piece. The closures could, however, be formed in two or more parts with at least the sealing rib formed separately from the top portion and the skirt portion.

In a fourth aspect, the present application can be directed to a further invention that comprises a container having an end portion defining an opening of the container, the end portion being sealed by a closure as defined herein.

In a fifth aspect, the present application is directed to another invention that comprises a container having an end portion defining an opening of the container that is sealable by a closure, the end portion comprising:

an outer surface, an inner surface and a free end;

an annular bead extending outwardly from the outer surface of the end portion and spaced a first distance from the free end, said annular bead being engageable with a complementary arrangement on a closure;

a first retaining flange extending outwardly from the outer surface of the end portion and spaced a second distance from the free end that is greater than the first distance; and a second retaining flange extending outwardly from the outer surface of the end portion and spaced a third distance from the free end that is greater than the second distance;

wherein the spacing between the first and second retaining flanges is such to prevent substantial longitudinal movement of a support ring of a closure once the closure is attached to the container.

In this aspect, the inner surface of the end portion can be cylindrical. The outer surface of the end portion between the free end and the annular bead also can be cylindrical. In this aspect, either or both of the respective joins between the free end and the inner surface and between the free end and the outer surface can be smoothly curved and define inner and outer sealing radii of the container.

The first retaining flange can be separated from the annular bead firstly by a cylindrical outer surface. This cylindrical outer surface can have a diameter that is greater than the diameter of the outer surface between the free end and the annular bead. The first retaining flange can have a first or upper side and a second or lower side. The first side can be frusto-conical in form with the flange becoming wider moving away from the free end of the end portion. The maximum outward extent of the first retaining flange can be greater than the annular bead.

The second side of the first retaining flange can be at least substantially normal or is normal to the cylindrical outer surface of the end portion defined above.

The second retaining flange can be spaced from the first retaining flange by a cylindrical outer surface. This cylindrical outer surface can have a diameter that is substantially the same or is the same as the diameter of the outer surface between the free end and the annular bead.

The second retaining flange can have a first or upper side and a second or lower side. The first side of the second retaining flange can have a compound surface. At least a portion or all of the first side can be smoothly curved. In another embodiment, at least a portion of the first side can be frusto-conical. The second retaining flange can also have a cylindrical outer surface. The second side of the second retaining flange can be substantially normal or normal to the cylindrical outer surface of the end portion defined above. The maximum outward extent of the second retaining flange can be greater than the first retaining flange.

In this aspect, the container can be sealed by a closure as defined herein.

In these aspects directed to the container, the container can be a container for a carbonated beverage, a gaseous beverage, an aerated beverage, or a still beverage. The container can be formed from polyethylene terephthalate (PET) or co-polymers thereof.

In a sixth aspect, the present invention comprises a mould for forming a closure as defined herein. The mould can be used to form the closure using injection and compression moulding. The mould can have a cavity that defines one or more of the features of the closure as defined above. It will be appreciated by persons skilled in the art that other suitable techniques for forming the closure could also be utilised.

In a seventh aspect, the present invention comprises a mould for forming a container as defined herein. The mould can be used in the blow moulding of the container.

In an eighth aspect, the present invention comprises a method of applying a closure as defined herein to an end portion of a container, the method comprising the steps of placing the closure onto the end portion of the container and then relatively longitudinally moving the closure relative to the end portion such that the closure is attached to the container.

In this aspect, the container can be a container as defined herein.

In this aspect, during the step of longitudinal movement, the support ring rides out and over the annular bead and the first retaining flange and is then held on the container between the first and second retaining flanges. During attachment, the second portion of the sealing rib is also engaged by the free end of the end portion and is pushed at least towards the first sealing portion so as to form a seal between the sealing rib and the end portion of the container as described herein.

BRIEF DESCRIPTION OF THE DRAWINGS

By way of example only, embodiments of the invention are now described with reference to the accompanying drawings, in which.

MODES OF CARRYING OUT THE INVENTION

Figure 1:
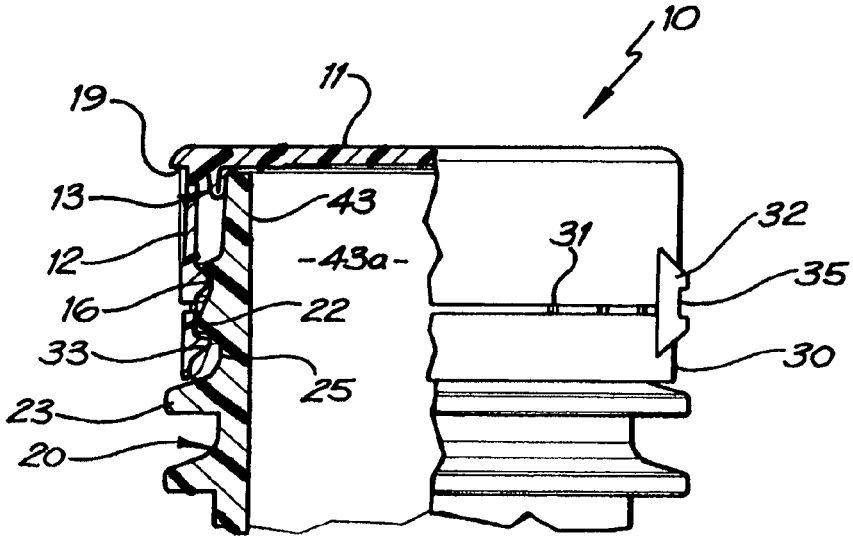
FIG. 1 is a view of a closure according to the present invention attached to a container according to the present invention.

One embodiment of a closure according to the present invention is depicted generally as 10 in the drawings.

The closure 10 as shown is moulded from a synthetic plastics material in a suitable mould. Such a mould has cavity defining the features of the depicted closure. The closure 10 comprises a top 11 and a depending skirt 12.

The radially inner surface of the skirt 12 is provided with a continuous annular bead 16 that engages with a corresponding bead 17 on the neck of a container 20 to which the closure 10 is attachable.

The spacing of the annular bead 16 from the top 11 of the closure 10 is slightly longer than the spacing between the annular bead 17 and the free end 41 of the end portion of the container 20. As such, the annular bead 16 on the closure 10 is adapted to ride out and over the bead 17 on the end portion and engage therebeneath on attachment of the closure 10 to the end portion and also when the closure is moved back to a closed position from an opened position.

While the depicted beads are continuous, one or both beads could be discontinuous.

A sealing rib 13 is provided on the underside of the top 11 of the closure 10. The rib 13 is continuous and annular. Seen in cross-section in FIG. 4, the depicted rib 13 has two portions 14 and 15. The first portion 14 is contiguous with the top 11 and, in the depicted embodiment, is spaced from the skirt 12. It will be appreciated that the first portion 14 could comprise a thickening of the skirt 12 adjacent the top 11. It is also conceivable that the first portion could be moulded such that it was in abutment with the skirt 12 for all or some portion of its length.

The depicted first portion 14 has a cylindrical inner surface. Non-cylindrical or only partially cylindrical inner surfaces can be envisaged.

The second portion 15 is contiguous with the first portion 14 and, prior to attachment of the closure 10 to the container 20, is frusto-conical in form and is of substantially constant thickness as it extends radially downwardly and inwardly from its outer edge which is contiguous with the lower end of the first portion 14. While depicted as being of substantially constant thickness, it will be envisaged that the second portion 15 can taper slightly in thickness as it extends radially inwardly from its outer edge. While the entire second portion 15 is depicted as frusto-conical, it will be appreciated that the second portion could be frusto-conical for only a portion of its length. In another embodiment, the second portion could be non-straight as it extends inwardly and downwardly into the cavity of the closure.

The second portion 15 extends for a length inwardly and downwardly from the distal end of the first portion 14 to a circular free edge. The second portion 15 is moulded at an angle relative to the notional plane extending at a right angle to the skirt portion of the closure.

The internal diameter of the inner surface of the first sealing portion 14 of the closure relative to the external diameter of the end portion of the container 20 is such that the second sealing portion 15, on attachment of the closure 10, is folded back towards the inner surface of the first sealing portion 14 (see FIG. 1). In this embodiment, The second sealing portion is even folded back against the first sealing portion 14 so that a seal is at least formed between the closure 10 and at least the outer surface of the end portion of the container 20 at a position away from the free end of the container end portion.

A relatively sharp edge is formed at the line of meeting between the first portion 14 and the second portion 15. The sharp edge is used to define a line of relative weakness between the two portions for a purpose that will be described later in this specification.

The container 20 to be sealed by the closure 10 has a neck having an end portion 40. In the depicted embodiment, the container 20 is a polyethylene terephthalate (PET) bottle. The container 20 can be returnable or non-returnable. The end portion 40 has a free end 41, an outside cylindrical surface 42 and an inside cylindrical surface 43, with the inside surface 43 defining a bore 43*a*. The join between the free end 41 and the inside surface 43 and the join between the free end 41 and the outside surface 42, on the container 20 are each smoothly curved and define, respectively, inner and outer sealing radii of the end portion 40 of the container 20. While the present closure 10 can seal containers 20 having the depicted end portion 40, it will be readily appreciated that the closure 10 can seal containers having different end portion configurations, eg. no outer and no inner sealing radii, or only one of the outer or inner sealing radii.

When the closure 10 is mounted to and relatively pushed down onto the end portion 40 of a container 20, the free end 41 of the end portion 40 engages the sealing rib 13 and starts to push the second portion 15 relatively upwardly within the closure 10. As the second portion 15 is pushed upwardly it bends relative to the first portion 14 along the line of weakness. This ensures that the folding of the second portion 15 relative to the first portion 14 takes place generally evenly around the whole circumference of the rib 13. As the closure 10 continues to be pushed onto the container 20, the second portion 15 is folded back towards the inner surface of the first portion 14.

Once the closure 10 is fully pushed onto the end portion 40, the sealing rib 13 is positioned between the end portion 40 and the underside of the top 11 of the closure 10. As depicted, the second portion 15 has been folded, in this case, back into contact with the inner cylindrical surface of the first portion 14. The second portion 15, while folded back against the inner surface, also bears against the outside surface 42 and at least onto the outer sealing radius of the end portion 40.

It will be appreciated that the degree of sealing engagement of the second portion 15 with the free end 41 of the end portion 40 will depend on a number of factors, including the relative length of the first and second portions, the wall thickness of the end portion 40, and the capping torque used to turn the closure 10 onto the end portion 40.

The skirt 12 of closure 10 terminates at an edge 18 distal the top 11. As depicted in FIG. 1, the closure is moulded such that a support ring 30 is joined to the edge 18 through a series of frangible bridges 31 and a hinge member 32. The hinge member 32 has a first end integrally joined to the skirt 12 at or adjacent the distal edge 18 and a second end integrally joined to the support ring 30. In the depicted embodiment, the hinge member 32 has a region of weakness 35 formed therein about which the skirt 12 is pivotable relative to the support ring 30.

Figure 2:
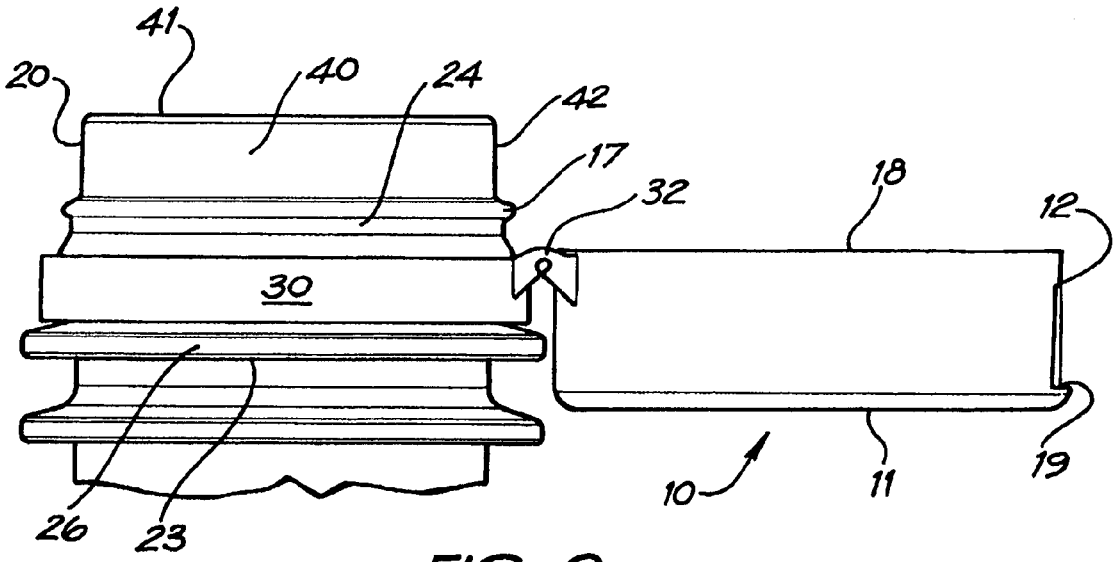
FIG. 2 is a view of the closure and container of FIG. 1 with the closure depicted in an opened orientation.

The skirt 12 is relatively movable to the support ring 30 about the hinge member 32. The skirt 12 is movable from a closed position where the end portion 40 of the container 20 is sealed by the closure 10 (as depicted in FIG. 1) to an open position (as depicted in FIG. 2) where the skirt 12 has pivoted about the hinge member 32 relatively away from the support ring 30. It will be appreciated that the skirt could pivot to one of a number of different open positions.

On attachment of the closure 10 to the end portion of the container 20, the closure 10 is constructed such that the skirt 12 is in the closed position relative to the support ring 30. In this case, the closure 10 is formed in one piece and is ready to be attached to the end portion of the container 20 and so seal that end portion without any necessity for post-moulding assembly of the closure 10.

The frangible bridges 31 extend between the skirt 12 of the closure 10 and the support ring 30 prior to and while the closure 10 is attached to the end portion of the container 20. The bridges 31 are formed so as to definitely break when an attempt is made to move the skirt 12 from the closed position to any opened position.

The frangible bridges 31 serve to provide tamper evidence for the closure 10 as the presence of broken bridges 31 serve to readily identify previous opening of the closure 10.

Figure 3:
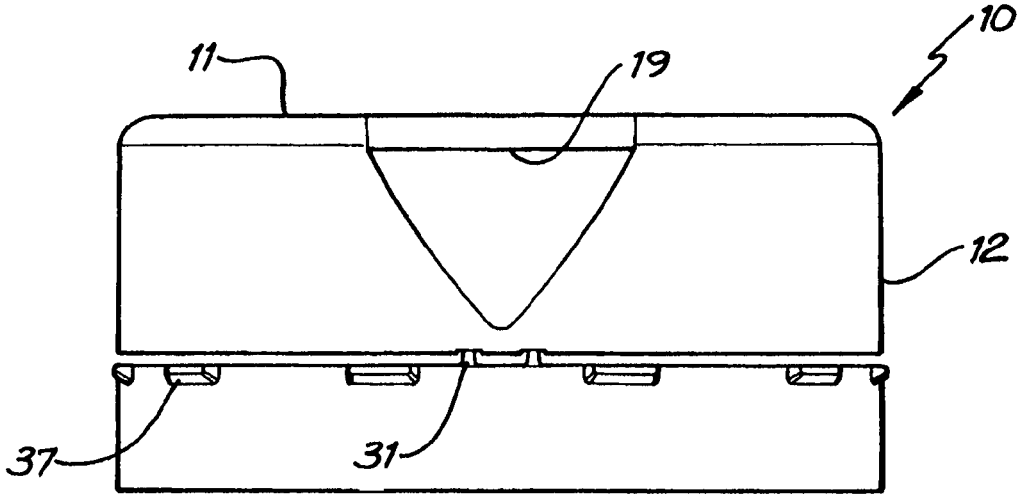
FIG. 3 is a side view of the closure.
Figure 4:
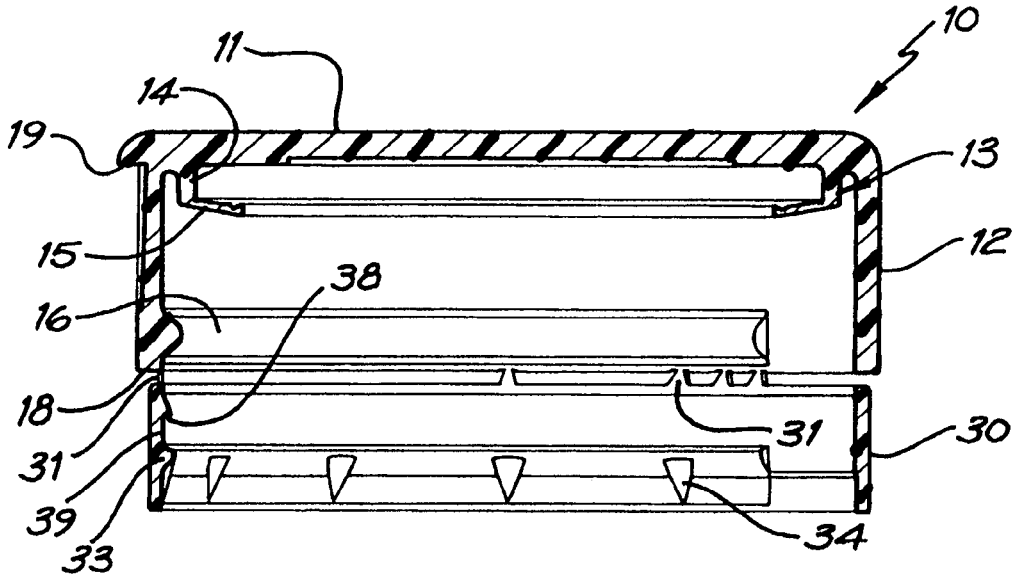
FIG. 4 is a part-sectional view of the closure depicted prior to attachment to a container with its sealing rib being depicted in one orientation prior to the closure being attached to the container and with the hinge member removed for clarity.

As depicted in FIGS. 3 and 4, two bridges 31 can extend between the skirt 12 and the support ring 30 at a location that is diametrically opposed to the location of the hinge member. A further set of three bridges 31 can also extend between the skirt 12 and the support ring 30 and be located on one or both sides of the hinge member. One further bridge 31 can be positioned about the circumference of the distal end of the skirt 12 between the sets of two and three bridges, respectively.

Figure 5:
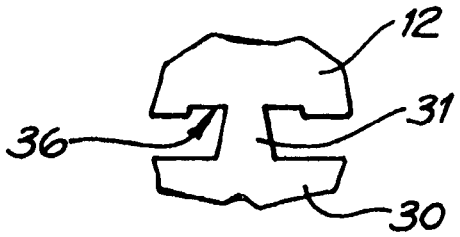
FIG. 5 is an enlarged view of one frangible bridge of the closure.

As depicted in FIG. 5, the bridges 31 can decrease in circumferential width towards the skirt portion end of the bridge. In addition to or instead of this decrease, the bridges can decrease in diametric thickness towards the skirt portion end of the bridge. This decrease is adapted to cause preferential rupturing of the bridges 31 at or adjacent the connection of the bridges with the distal end of the skirt 12.

As depicted more clearly in FIG. 5, a first end of the bridge 31 is joined to the skirt portion in a recess 36 formed in the distal end of the skirt 12. The bridges 31 are adapted to rupture such that the break in the bridge is at least partially within the recess 36. In the depicted embodiment, the spacing between the distal end of the skirt 12 and the adjacent edge of the support ring 30, except at the location of the recesses is about 0.5 mm. Each recess 36 has a depth of about 0.1 mm, such that the length of each bridge 31 is about 0.6 mm.

While the drawings depict the above features of the bridges in combination with other features defined herein, it is to be appreciated that the features of the bridges could be used on other closure types than that depicted.

The inner surface of the support ring 30 has a rib 33 that extends inwardly and provides a lip having an inner free edge to engage under a first retaining flange 22 extending outwardly from the end portion of the container. The combined length of the rib 33 is greater than 50% of the internal circumference of the ring 30 but stops short of the region of the hinge member. The rib 33 has an upper surface facing generally towards the top 11 and an underside facing generally away from the top 11. The inner surface of the ring 30 also has a plurality of radially inward projections or ramp members 34 extending from above the free edge of the ring and not extending beyond the inner free edge of the lip.

The upper surface of the rib 33 extending inwardly of the body portion is a compound surface and is comprised of a first surface that is contiguous with the body portion of the ring 30, which surface has a slope that slopes inwardly and downwardly away from the top 11, and a second surface which extends radially inwardly from the inner terminus of the first surface and has a slope angle that is substantially normal to the body portion of the ring 30.

In addition to the rib 33, the depicted ring 30 has an undercut 38 providing an abutment surface that is formed in the inner surface of the body portion above the rib. The undercut 38 defines the upper extremity of a region 39 of the body portion that is thinner than the body portion immediately above and below that region. The abutment surface provided by the undercut 38 can bear on the upper surface of the retaining flange 22 of the container on relatively downward movement of the support ring 30 on the end portion and so resist that downward movement. The abutment surface is formed substantially at right angles to the inner surface of the body portion of the support ring 30. The spacing of the undercut 38 from the upper surface of the rib 33 is just greater than the thickness of the retaining flange 22 on the container. The combination of the rib 33 and the undercut 38 serves to hold the support ring 30 in position on the end portion of the container, especially when the skirt 12 is moving from the closed to the opened position.

While the drawings depict the above features of the undercut 38 in combination with other features defined herein, it is to be appreciated that the feature of the undercut 38 could be used on other closure types than that depicted.

The depicted outer surface of the support ring 30 is cylindrical. As depicted in FIG. 3, the outer surface can have a number of projections 37 extending outwardly therefrom. As depicted, the projections 37 are located adjacent the upper edge of the support ring 30. Each of the projections 37 have a circumferential length that is longer than its height and serve to stiffen the ring 30 adjacent its connection to the bridges 31. This increase in stiffness assists in ensuring that the closure 10 can be positioned on the end portion of the container without breaking the bridges 31. The projections 37 are equally spaced about the circumference of the support ring except in the location of the hinge member.

The top 11 can be circular but have a finger pad 19 attached thereto distal the hinge 32. This finger pad 19 allows a consumer to more readily exert relatively upward pressure on the top 11 of the closure when that consumer wishes to move the skirt 12 of the closure from its closed to an open position. By exerting sufficient pressure, the frangible bridges 31 break and the skirt 12 begins to pivot relative to the support ring 30 about the hinge member 32 thereby opening the container 20.

The height of the support ring 30 is such that the ring, once attached to the end portion of the container 20, is held substantially in position on the end portion between the first retaining flange 22 and a second retaining flange 23. The first retaining flange 22 is adapted with the lip of the segmented rib 33. The second retaining flange 23 is spaced below the first retaining flange 22 by a distance that ensures there is abutment with the lower edge of the support ring 30 when the support ring 30 has ridden over and is below the first retaining flange 22. While the spacing between the respective retaining flanges can be such to hold the support ring in position, it will be appreciated that some movement of the support ring 30 longitudinally on the end portion of the container between the retaining flanges would be acceptable.

As depicted, the container 20 has an annular bead 17 extending outwardly from the outer surface of the end portion and which is spaced a first distance from the free end 41, a first retaining flange 22 which extends outwardly from the outer surface of the end portion and is spaced a second distance from the free end 41 that is greater than the first distance, and a second retaining flange 23 which extends outwardly from the outer surface of the end portion and is spaced a third distance from the free end 41 that is greater than the second distance. The spacing between the first and second retaining flanges is such to prevent substantial longitudinal movement of the support ring 30 of the closure 10 when the closure 10 is attached to the container 20.

The inner surface 43 of the end portion is cylindrical. The outer surface 42 of the end portion between the free end 41 and the annular bead 17 is also cylindrical. The first retaining flange 22 is separated from the annular bead 17 firstly by a cylindrical outer surface portion 24. This cylindrical outer surface portion 24 has a diameter that is greater than the diameter of the outer surface between the free end 41 and the annular bead 17. The first retaining flange 22 has a first or upper side and a second or lower side. The first side is frustoconical in form with the flange becoming wider moving away from the free end 41 of the end portion. The maximum outward extent of the first retaining flange 22 is greater than the annular bead 17. The second side of the first retaining flange 22 is substantially normal to the cylindrical outer surface of the end portion defined above.

The second retaining flange 23 is spaced from the first retaining flange 22 by a cylindrical outer surface portion 25. This cylindrical outer surface 25 has a diameter that is substantially the same as the diameter of the outer surface between the free end 41 and the annular bead 17.

The second retaining flange 23 has a first or upper side and a second or lower side. The first side of the second retaining flange 23 is smoothly curved as the flange 23 expands to its maximum extent which is defined by a cylindrical outer surface 26. The second side of the second retaining flange 23 is substantially normal to the cylindrical outer surface of the end portion defined above. The maximum outward extent of the second retaining flange 23 is greater than the first retaining flange 22.

The container 20 can be used for carbonated beverage or aerated beverages, or a still beverage. The container can be blow-moulded in a mould from polyethylene terephthalate (PET) or co-polymers thereof.

The process of applying the closure 10 to an end portion of the container 20 comprises the steps of placing the closure 10 onto the end portion of the container and then relatively longitudinally pushing the closure 10 relatively onto the end portion such that the closure 10 is attached to the container 20.

During attachment, the support ring 30 rides up and over the annular bead 17 and the first retaining flange 22 and is then held on the container between the first and second retaining flanges. At the same as this, the second portion 15 of the sealing rib 13 is engaged by the free end 41 of the end portion and is pushed at least towards the first sealing portion 14 so as to form a seal between the sealing rib 13 and the end portion of the container as described herein.

The present invention provides a closure that is readily simple to manufacture and can be readily attached to a container while at the same time has sealing properties that allow the closure to be used for aerated or carbonated beverages and which can be opened and re-sealed if necessary using one hand.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A closure suitable for attachment to a container having an end portion having a free end defining an opening of the container, the closure comprising:

a top portion;

a skirt portion depending from the top portion to an end distal the top portion, said top portion and skirt portion defining a cavity;

a support ring which is hingedly connected to said skirt portion;

a first sealing portion depending from the top portion and having a cylindrical inner surface; and a second sealing portion separated from the top portion by the inner surface of the first portion and which, prior to attachment of the closure to the container, extends at least inwardly into said cavity for a length to a free edge positioned inwardly of the skirt portion;

wherein the length of the second portion is such that, during attachment of the closure with the end portion of the container, the end portion of the container contacts the second portion and pushes it upwardly and at least towards the first sealing portion of the closure to form a seal between the end portion of the container and the closure;

wherein the support ring comprises a generally cylindrical body portion and a rib extending inwardly from an inner surface of the body portion that provides a lip having an inner free edge to engage under a retaining flange extending outwardly from the end portion of the container but spaced a distance from the free end thereof;

wherein an undercut is formed on the inner surface of the support ring above the rib, the undercut providing an abutment surface and defining an upper extremity of a region of the body portion that is thinner than the body portion immediately above and below that region; and wherein the abutment surface provided by the undercut is substantially at a right angle to the inner surface of the support ring and bears on the upper surface of the retaining flange of the container on relatively downward movement of the support ring on the end portion and so resists that downward movement.

2. The closure of claim 1 wherein the support ring and skirt portion are hingedly connected by a single hinge member that extends between the support ring and the skirt portion of the closure.

3. The closure of claim 2 wherein the hinge member has a line of weakness formed therein about which the skirt portion pivots relative to the support ring.

4. The closure of claim 1 wherein in addition to being hingedly mounted to the support ring, at least one frangible bridge extends between the skirt portion of the closure and the support ring prior to and while the closure is attached to the end portion of the container.

5. The closure of claim 4 wherein said at least one frangible bridges is shorter in circumferential length than the hinge member.

6. The closure of claim 4 wherein there is a plurality of frangible bridges that are non-equally spaced around the circumference of the skirt portion.

7. The closure of claim 4 wherein said at least one bridge decreases in circumferential width towards the skirt portion end of the bridge.

8. The closure of claim 7 wherein the skirt portion end of said at least one bridge is joined to the skirt portion in a respective recess formed in the distal end of the skirt portion.

9. The closure of claim 4 wherein the support ring has an outer surface having one or more projections extending outwardly therefrom, said projections being located adjacent the upper edge of the support ring and serving to stiffen the ring adjacent its connection to the bridges.

10. The closure of claim 1 wherein the closure is provided with an annular bead on an inside surface of the skirt portion that is engageable with a corresponding annular bead on an external surface of the end portion of the container.

11. The closure of claim 1 wherein a finger pad extends out from the skirt distal the hinge member and allows a user or consumer to more readily exert relatively upward pressure on the top portion of the closure when that person wishes to move the skirt portion of the closure from a closed to an open position.

12. The closure of claim 1 wherein the height of the support ring is such that the ring, once attached to the end portion of the container, is held substantially in position on the end portion between a first and second retaining flange.

13. A closure suitable for attachment to a container having an end portion having a free end defining an opening of the container, said end portion having a retaining flange extending outwardly from the end portion and spaced a distance from the free end thereof, the closure comprising:

a top portion;

a skirt portion depending from the top portion to an end distal the top portion, said top portion and skirt portion defining a cavity; and a support ring which is connected to said skirt portion by a frangible connection;

wherein said support ring comprises a generally cylindrical body portion having a rib extending inwardly of the body portion that provides a lip having an inner free edge to engage under the retaining flange, and an undercut providing an abutment surface that is formed in the inner surface of the body portion above the rib and which is engageable with an upper surface of the retaining flange on relatively downward movement of the support ring to the end portion;

wherein the undercut defines the upper extremity of a region of the body portion that is thinner than the body portion immediately above and below that region; and wherein the abutment surface provided by the undercut is substantially at a right angle to the inner surface of the support ring and bears on the upper surface of the retaining flange of the container on relatively downward movement of the support ring on the end portion and so resists that downward movement.

14. The closure of claim 13 wherein the frangible connection comprises at least one frangible bridge that extends between the skirt portion and the support ring.

15. A container having an end portion defining an opening of the container, the end portion being sealed by a closure as defined in claim 1.

16. A container having an end portion defining an opening of the container, the end portion being sealed by a closure as defined in claim 13.

17. A closure suitable for attachment to a container having an end portion having an inner surface, an outer surface and a free end defining an opening of the container, the outer surface having spaced and parallel first and second retaining flanges each spaced a respective distance from the free end, the closure comprising:

a top portion;

a skirt portion having an unthreaded inside surface and depending from the top portion to an end distal the top portion, said top portion and skirt portion defining a cavity;

a support ring which is hingedly connected to said skirt portion;

a first sealing portion depending from the top portion and having a cylindrical inner surface; and a second sealing portion separated from the top portion by the inner surface of the first portion and which, prior to attachment of the closure to the container, extends at least inwardly into said cavity for a length to a free edge positioned inwardly of the skirt portion;

wherein the length of the second portion is such that, during attachment of the closure with the end portion of the container, the end portion of the container contacts the second portion and pushes it upwardly and at least towards the first sealing portion of the closure to form a seal between the end portion of the container and the closure;

wherein the support ring comprises a generally cylindrical body portion having a free edge and a rib extending inwardly from an inner surface of the body portion that provides a lip having an inner free edge and wherein once the support ring is attached to the end portion of the container, the lip engages under the first retaining flange extending outwardly from the end portion of the container and the free edge of the support ring abuts the second retaining flange, such that the support ring is held in position on the end portion between said spaced retaining flanges; and wherein the closure is also provided with an annular bead on the inside surface of the skirt portion that is engageable with a corresponding annular bead positioned on an external surface of the end portion of the container between said container free end and the first retaining flange.

18. The closure of claim 17 wherein the support ring and skirt portion are hingedly connected by a single hinge member that extends between the support ring and the skirt portion of the closure.

19. The closure of claim 18 wherein the hinge member has a line of weakness formed therein about which the skirt portion pivots relative to the support ring.

20. The closure of claim 17 wherein a finger pad extends out from the skirt distal the hinge member and allows a user or consumer to more readily exert relatively upward pressure on the top portion of the closure when that person wishes to move the skirt portion of the closure from a closed to an open position.

* * * * *